United States Patent [19]

Sortini

[11] 4,098,517

[45] Jul. 4, 1978

[54] CONVERTIBLE RIDING TOY

[76] Inventor: Adam J. Sortini, 6204 E. Gettysburg, Clovis, Calif. 93612

[21] Appl. No.: 787,554

[22] Filed: Apr. 14, 1977

[51] Int. Cl.[2] ..... A63G 19/00

[52] U.S. Cl. ..... 280/1.12; 280/1.188; 280/1.21

[58] Field of Search ..... 280/1.11 R, 1.11 A, 280/1.12, 1.188, 1.189, 1.21, 1.208, 7.15, 87.01

[56] References Cited

U.S. PATENT DOCUMENTS

| | | | |
|---|---|---|---|
| 1,681,438 | 8/1928 | Scourtes | 280/1.12 X |
| 2,503,707 | 4/1950 | Braman | 280/1.21 X |

*Primary Examiner*—Kenneth H. Betts
*Assistant Examiner*—R. S. Schrecengost
*Attorney, Agent, or Firm*—Huebner & Worrel

[57] ABSTRACT

A convertible riding toy adapted selectively to simulate an automobile, a boat, and an airplane, having a body provided with an operator's cockpit and adapted for ground traversing movement; a pair of wings oppositely swivel mounted laterally of the body and adapted selectively to be positioned in a concealed, rearwardly extending automobile simulating positions within slots in the body, laterally extending aircraft wing simulating positions, and a converging, forwardly extending position for simulating the bow of a boat; a vertically slidable rudder member selectively for simulating the rudder of an airplane or of a boat; and a pair of airplane motor simulating discs adapted selectively to be retracted or to be laterally extended from the body.

9 Claims, 8 Drawing Figures

CONVERTIBLE RIDING TOY

BACKGROUND OF THE INVENTION

1. Field of the Invention

The present invention relates to a convertible riding toy, and more particularly to such a toy which can be selectively configured to simulate an aircraft, a sail boat, or an automobile.

2. Description of the Prior Art

It has long been recognized that riding toys and other toys with surface traversing elements simulating some mode of powered transportation have great appeal to children. However, existing toys of this kind generally simulate only one mode of transportation.

Of course, it would be possible to provide a plurality of such toys individually simulating separate modes of transportation, but this would be relatively expensive because of the need to duplicate portions of the toys, such as the propelling and steering mechanism. Also, the provision of a plurality of such toys would not provide any interest or have any educational value beyond what is inherent in the individual toys.

SUMMARY OF THE INVENTION

Accordingly, it is an object of the present invention to provide a surface traversing toy which has a plurality of configurations, each selectively simulating a different mode of powered transportation.

Another object is to provide such a toy which can be altered from one such configuration to another by a child.

Another object is to provide a single such toy which will maintain a child's interest by the variety of configurations provided and by the manipulations required selectively to alter the toy into such configurations.

Another object is to provide such a toy which assists a child in developing manual dexterity.

Another object is to provide a single and, therefore, relatively economical toy which serves, in effect, as a plurality of toys.

A further object is to provide such a toy which is rugged and safe for use by a child.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
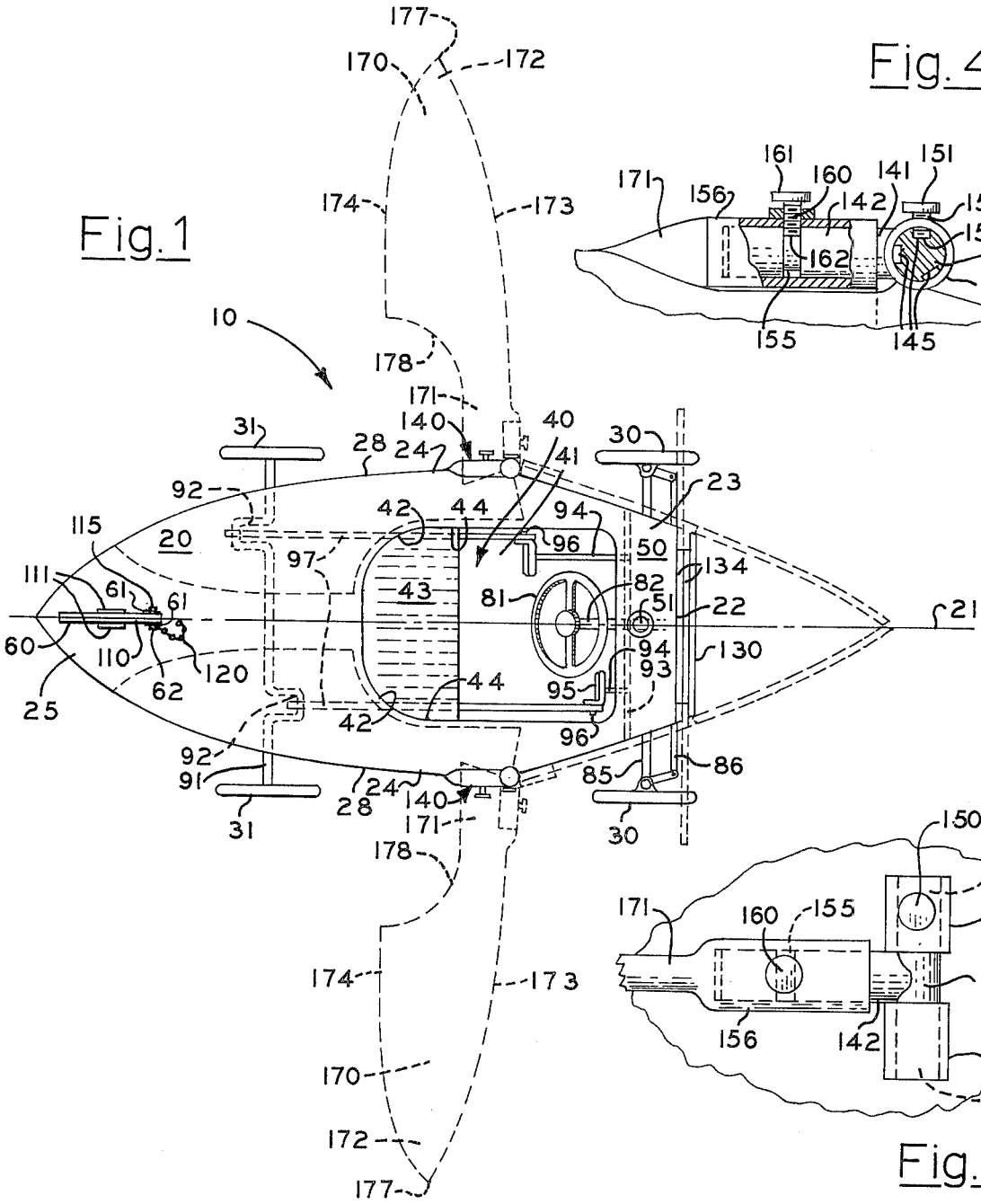
FIG. 1 is a top plan view of a convertible riding toy embodying the principles of the present invention in an automobile simulating configuration, with dashed lines showing the relative positions of elements thereof in an airplane simulating configuration, and in a boat simulating configuration.
Figure 6:
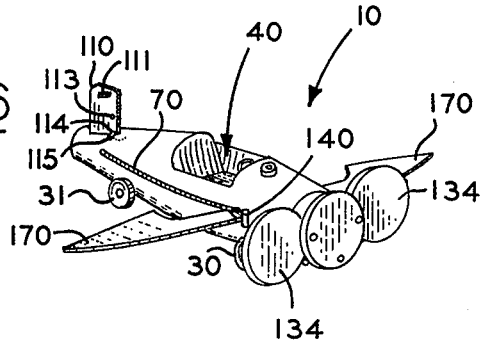
FIG. 6 is a perspective view of the toy in the airplane simulating configuration.
Figure 7:
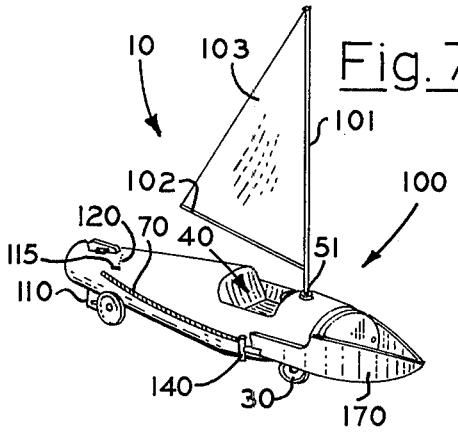
FIG. 7 is a perspective view of the toy in the boat simulating configuration.
Figure 8:
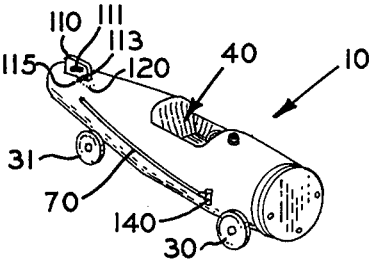
FIG. 8 is a perspective view of the toy in the automobile simulating configuration.

Referring more particularly to the drawings, a convertible riding toy, indicated generally by the numeral 10, which embodies the principles of the present invention is shown in FIG. 1 with adjustably positionable portions in exemplary arrangement in dashed lines, in an aircraft simulating configuration in FIG. 6, in a sail boat simulating configuration in FIG. 7, and, in an automobile simulating configuration in FIG. 8.

Figure 2:
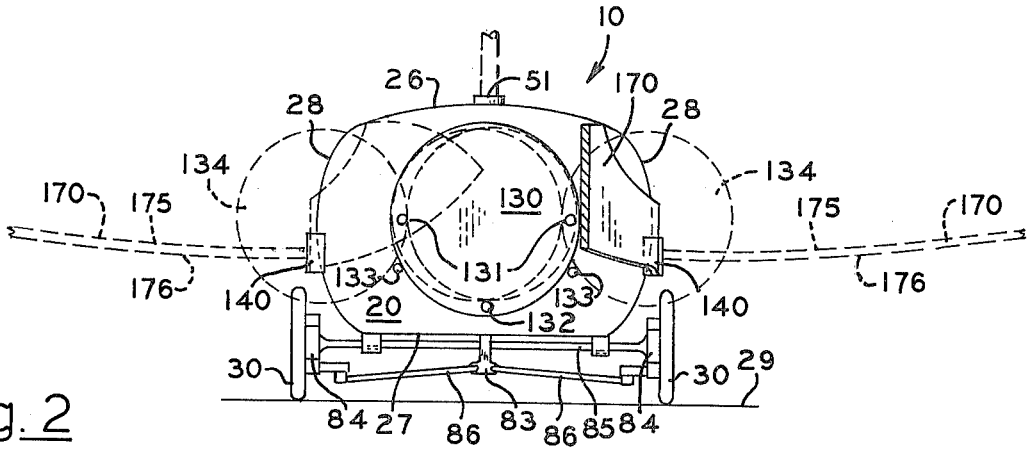
FIG. 2 is a front elevation of the toy of FIG. 1 with a vertical section of a wing positioned in the boat simulating configuration.
Figure 3:
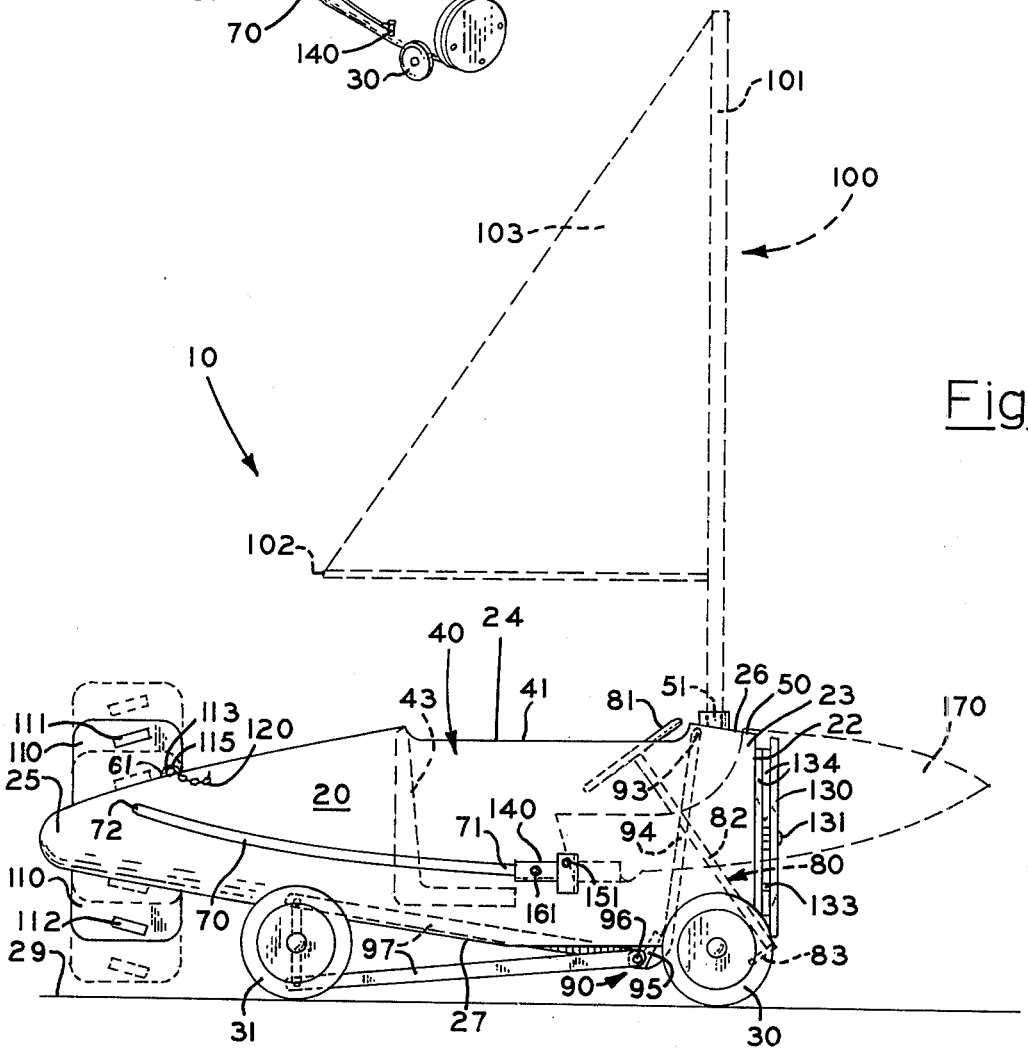
FIG. 3 is a side elevation of the toy of FIG. 1 showing a mast and a sail utilized in the boat simulating configuration in dashed lines.

As best shown in FIGS. 1, 2, and 3 the toy 10 has a body 20 of substantially hollow construction and substantially streamline form, having a central longitudinal axis 21, a forward end 22, a forward portion 23, a longitudinally central portion 24, a rearward end portion 25, an upper surface 26, a lower surface 27 and transversely opposite sides 28. The body is supported for movement traversing a ground surface 29 by a forward pair of steerable wheels 30 and a rearward pair of propelling wheels 31 mounted on the lower surface of the body.

The body 20 has an operator's cockpit, indicated generally by the numeral 40, positioned longitudinally and transversely centrally in the body. The cockpit has a generally rectangular opening 41 in the upper surface 26 of the body for operator access and vision. As best seen in FIG. 1, the rearward corners 42 of the generally rectangular opening 41 of the cockpit are concave. The cockpit also has a forwardly facing seat 43 within the body and disposed below the cockpit opening 41. The transversely outward portions 44 of the seat preferably have a shape conforming to the curved rearward corners 42 of the cockpit opening 41.

The upper surface 26 of the body between the cockpit opening 41 and the forward end 22 of the body forms a simulated boat deck or automobile hood 50. A substantially vertical socket 51 is provided in the deck 50 coincident with the longitudinal axis 21. A substantially vertical slot 60 is provided through the rearward end portion 25 of the body 20 also coincident with the longitudinal axis 21 and opens through the upper surface 26 and the lower surface 27 of the body. A pair of vertical ears 61 project from the upper surface of the body individually laterally opposite the slot 60. A pair of aligned horizontal transverse bores 62 are individually provided in the ears 61. As best shown in FIG. 3, the sides 28 of the body have individual wing receiving slots 70 extending rearwardly from forward ends 71 outwardly of the middle of the cockpit to rearward ends 72 outwardly of the middle of the vertical slot 60 in the rearward portion of the body. The forward ends of the wing receiving slots are vertically positioned somewhat below the vertical center of the body, and the slots curve upwardly from their forward ends 71 to their longitudinally central portions in curves substantially conforming to the streamlined shape of the sides 28 of the body forwardly of the wing receiving slots.

The body 20 has a steering mechanism indicated generally by the numeral 80 and best shown in FIGS. 1 and 3, having a steering wheel 81 forwardly and upwardly positioned in the cockpit 40 fixed to a steering shaft 82 rotatably mounted on the body and extending forwardly and downwardly coincidently with the longitudinal axis from the steering wheel to a pitman arm 83 between the steerable wheels 30. The steerable wheels 30 are individually rotatably mounted on steering knuckles 84 which are individually pivotally mounted for steering movement of the steerable wheels on the opposite ends of a forward axle 85 extending transversely between the steerable wheels. A pair of tie rods 86 are pivotally connected to the pitman arm and extend oppositely transversely outward therefrom to individual pivotal connections with the steering knuckles.

The body 20 is provided with a pedal driven propelling mechanism, indicated generally by the numeral 90 and best shown in FIGS. 1 and 3. A rearward axle 91 extends transversely between and is fixed to the centers of the propelling wheels 31. If preferred only one rear wheel can be driven and the other freely rotatable on the axle. The rearward axle 91 is mounted for rotational movement on the body and is provided with a pair of cranks 92 on opposite sides of the longitudinal axis. A support rod 93 extends transversely within the body adjacent to the simulated boat deck 50. A pair of links 94 are pivotally mounted on and extend downwardly from the support rod to individual pedal ends 95 conveniently positioned for the feet of an operator. The pedal ends of the links have transverse pedal pins 96 for individual engagement by the feet of the operator. A connecting rod 97 interconnects each pedal pin 96 with its transversely corresponding crank 92.

It is to be understood that, although this description of the preferred embodiment involves a toy 10 of a size suitable for seating of a child within the cockpit 40, the invention is not limited to a toy of any particular dimensions, and the invention is also susceptible to embodiment in toys of a small size, such as toys to be pulled by a string. It is to be further understood that, although the preferred embodiment described herein is propelled by pedals actuated by the feet of an operator, any other desired form of propulsion may be utilized such as energy supplied by electric batteries or, in said smaller embodiments, by mechanical spring motors.

As shown in FIGS. 2 and 3, the toy 10 is provided with a boat simulating assembly 100 shown in dashed lines. The boat simulating assembly has a vertical mast 101 adapted at its lower end for releasable mounting in the socket 51 of the simulated boat deck 50. The mast is preferably provided adjacent to its lower end with a boom 102 and sail 103.

A planar tail piece or rudder simulating member 110 is slidably mounted, as best shown in FIGS. 1 and 3, for vertical movement in the slot 60 through the rearward end portion 25 of the body 20. An upper pair 111 of stop projections and a lower pair 112 of stop projections are mounted on the rudder member toward, respectively, the upper and lower ends thereof. The upper pair 111 and lower pair 112 of stop projections individually extend laterally from the rudder member outwardly of the slot 60, and are adapted to engage, respectively, the upper surface 26 and the lower surface 27 of the body. The rudder member is provided with an upper transverse bore 113 and a lower transverse bore 114 adapted for registration with the aligned bores 62 in the ears 61 laterally opposite of the slot 60. A pin 115 can be slidably fitted through the lower bore 114 when the lower bore is aligned with the bores to retain the rudder member in an upwardly extending aircraft rudder simulating position shown in FIG. 6 and indicated by dashed lines in FIG. 3. Similarly, the upper bore 113 can be aligned with the bores 62 and the pin 115 inserted, to retain the rudder member in a central position shown in FIGS. 8 and 3 for automobile simulation. The rudder member can also assume a downwardly extending boat rudder simulating position, shown in FIG. 7 and indicated by dashed lines in FIG. 3 in which the upper pair of stop projections engage the upper surface 26 of the body. The lower pair 112 of stop projections together with the upper pair 113 of stop projections retain the rudder member on the body. A chain 120 preferably interconnects the pin 115 and the body 20 to retain the pin against loss.

As best shown in FIGS. 1, 2 and 3, a vertical, planar automotive radiator simulating member 130 is rigidly mounted on the forward end 22 of the body 20 substantially coaxially with the longitudinal axis 21. The radiator simulating member is mounted in forwardly spaced relation on the body by a pair of laterally disposed, horizontal interconnecting posts 131 individually fixed to the transversely opposite edges of said member and by a third centrally disposed, horizontal interconnecting post 132 fixed to the lower edge of said member below the longitudinal axis 21. A pair of horizontal stop posts 133 extend forwardly from the body 20 to the radiator simulating member 130 and are individually positioned below the laterally disposed horizontal posts 131. A pair of vertical, aircraft motor simulating discs 134 are individually mounted toward the edges thereof for pivotal movement about axes defined by the posts 131. The motor simulating discs are mounted between the forward end 22 of the body and the radiator simulating member with, as shown in FIGS. 1, 3 and 8, one of said discs being mounted forward of the other. The motor simulating discs are adapted selectively for pivotal movement into inwardly retracted positions, best shown in FIGS. 1, 2 and 8 between the front end of the body and the radiator simulating member, and into outwardly extending motor simulating positions, shown in dashed lines in FIGS. 1 and 2 and in FIG. 6. As shown in FIG. 2, the motor simulating discs are prevented from pivoting downwardly beyond their retracted or extended positions by engagement of the respective lower edges of the discs with the third post 132 when in the retracted positions and with the laterally corresponding stop posts 133 when in the aircraft motor simulating positions.

Figure 4:
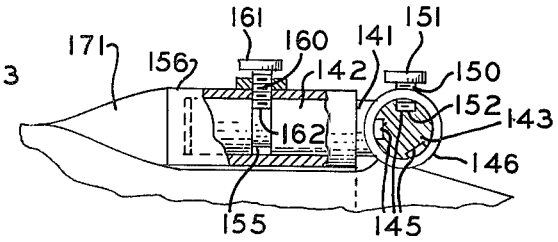
FIG. 4 is a top plan view of a swivel for mounting a wing on the toy with a portion broken away to show a thumbscrew adapted to lock the swivel in position.
Figure 5:
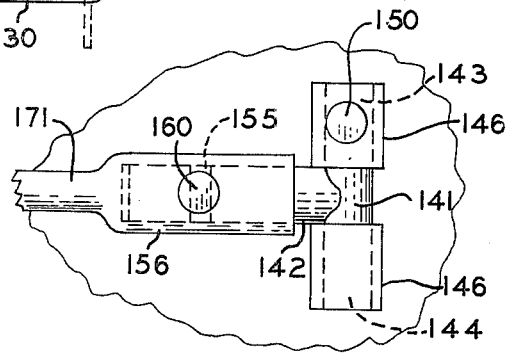
FIG. 5 is a side elevation of the swivel of FIG. 4.

As best shown in FIGS. 1, 3, 4 and 5, a pair of wing swivels, indicated generally by the numeral 140, are individually mounted on the opposite sides 28 of the body 20 forwardly of the wing receiving slots 70. As best shown in FIGS. 4 and 5, each swivel has a T-shaped member 141 having substantially cylindrical horizontal arms 142 with a substantially cylindrical upper arm 143 extending upwardly from one end of the horizontal arm and with an opposite downwardly extending, substantially cylindrical lower arm 144. Each upper arm 143 has three horizontal bores 145 corresponding, respectively, to the aircraft simulating configuration shown in FIG. 6, the boat simulating configuration shown in FIG. 7, and the automobile simulating configuration shown in FIG. 8. The arms 143 and 144 are individually pivotally mounted in rings 146 fixed to the sides 28 of the body 20. The rings 146 corresponding to the upper arms 143 of the T-shaped members 141 are individually screw threadably engaged by first thumbscrews 150 having heads 151 and opposite ends 152. The axes of the thumbscrews are horizontally and transversely disposed for axial movement relative to the rings 146 to engage the ends 152 of the thumbscrew with the bores 145 in the upper arms 143 of the T-shaped member. A circumferential groove 155 extends about the middle portion of each horizontal, cylindrical arm 142 of the T-shaped member. Cylindrical wing mounting sockets 156 are individually fitted to said horizontal arms 142 for rotational movement relative thereto. Second thumbscrews 160 having heads 161 and opposite ends 162 individually screw threadably engage the sockets 156 for relative axial movement thereto perpendicularly to the axes of their respective sockets to engage the ends 162 of the second thumbscrews with the corresponding circumferential grooves 155.

The toy 10 has a pair of laterally opposite plate-like elongated wings, indicated generally by the numeral 170 and best shown in dashed lines in FIGS. 1 and 2 each having a root portion 171 disposed toward the side 28 of the body 20 when the toy is in the aircraft simulating configuration shown in FIG. 6, a tip portion 172 opposite the root portion, a leading edge 173 forwardly disposed when the toy is in said aircraft simulating configuration, a trailing edge 174 opposite the leading edge, an upper surface 175 which is upwardly disposed when the toy is in said configuration, and a lower surface 176 which is downwardly disposed when the toy is in said configuration. The cylindrical wing mounting socket 156 of the corresponding swivel 140 is fixed to the root portion of the wing at the leading edge thereof with the axis of said socket generally parallel to said leading edge. As best shown in FIG. 1, the leading edge and tip portion of the trailing edge convergently curve forming an apex 177 at the tip portion of the wing. Said curve of the leading edge conforms to the substantially streamlined shape of a side 28 of the body 20 rearwardly of the swivel 140. Said curve of the tip portion of the trailing edge is of a form which does not engage the rudder member 110 in the slot 60 in the rearward end portion 25 of the body when the toy is in the automobile simulating configuration 13. The root portion of the trailing edge of the wing has a recess 178 substantially conforming to the shape of the opening 41 of the operator's cockpit 40 rearwardly of the swivel 140.

The upper surface 175 of each wing 170 is of concave curvature with the root portion substantially conforming to the streamlined shape of the sides 28 of the body 20 forwardly of the swivels and adapted to engage the laterally disposed portions of the edges of the motor simulating discs 134 when the toy 10 is in the boat simulating configuration shown in FIG. 7. The tip portion of the upper surface of each wing is curved for convergence of the wing toward the longitudinal axis 21 when the toy is in said boat simulating configuration. The lower surface 176 of the wing is of convex curvature for substantial parallelism with the upper surface 175 thereof.

The wings 170 are adapted by relative pivotal movement of the elements of the swivels 140 and by engagement of the first thumbscrews 150 thereof with the appropriate bores 145 to swivel into and be maintained in the following positions:

An aircraft wing simulating position, best shown in FIGS. 1, 2 and 6, in which the wings 170 extend laterally and generally horizontally with the tip portions 172 thereof disposed outwardly of the respective root portions 171 thereof.

A boat bow simulating position, best shown in FIGS. 1, 2 and 7, in which wings extend forwardly and generally vertically with the tip portions 172 thereof disposed forwardly of the respective root portions 171 thereof and with the upper surfaces 175 thereof juxtapositioned to the laterally corresponding sides 28 of the body so that the trailing edge 174 is downwardly disposed and the leading edge 173 is upwardly disposed.

A retracted, substantially concealed, or automobile simulating position, best shown in FIGS. 1, 3, and 8 in which the wings extend rearwardly and generally horizontally with the tip portions 172 thereof rearwardly of the root portions 171 thereof and positioned within the wing receiving slots 70 in the sides 28 of the body 20.

OPERATION

The operation of the described embodiment of the present invention is believed to be clearly apparent and is briefly summarized at this point. Before riding in the toy 10, it is first set up, as desired, in its aircraft simulating configuration shown in FIG. 6, its boat simulating configuration shown in FIG. 7, or its automobile simulating configuration shown in FIG. 8.

To set up the toy 10 in the aircraft simulating configuration, the boat simulating assembly 100 is, of course, removed and the wings 170 are placed in their aircraft wing simulating position 180 by loosening the first thumbscrews 150 and the second thumbscrews 160 of the swivels 140 and pivoting the wings into the aircraft wing simulating position. The wings are secured in said positions by engaging the first thumbscrews into their respective bores 145 in the upward arms 143 of the T-shaped member 141 of the swivel which correspond to said position; and by tightening the second thumbscrews into engagement with their respective horizontal arms 142 of the T-shaped member. The rudder member 110 is slid into its upward, aircraft rudder simulating position in the vertical slot 60 in the rearward end portion 25 of the body 20 with the lower bore 114 in the rudder member aligned with the bores 62 in the ears 61. The rudder member is secured in its aircraft rudder simulating position by insertion of the pin 115 through the bores 113 and 62. The aircraft motor simulating discs 134 are pivoted outwardly about the lateral pair of posts 131 interconnecting the front end of the body 72 and the radiator simulating member 130 into the extended positions of said discs in which they engage their respective stop posts 133.

To set up the toy 10 in its boat simulating configuration, the aircraft motor simulating discs 134 are pivoted inwardly into their retracted positions engaging the central post 132 interconnecting the front end 22 of the body 20 with the radiator simulating member 130. The wings 170 are pivoted into their boat bow simulating position and secured therein by utilizing the swivels 140 and the thumbscrews 150 and 160 in a manner similar to that previously described for placing the wings in their aircraft simulating position. When the wings are in their boat simulating positions, as shown in FIG. 2, the upper surfaces 175 of the wings extend upwardly of the lateral pair of posts 131 so that the aircraft motor simulating discs 134 cannot bounce out of their retracted positions 135. The rudder member 110 is placed in its downward, boat simulating position by removing the pin 115 from the bores 62 in the ears 61 and from the corresponding bores 113 and 114 in the rudder member allowing the rudder member to slide downwardly in the vertical slot 60 until the upper pair of stop projections 111 engage the upper surface 26 of the body 20 gravitationally to maintain the rudder member in its boat simulating position. The pin 115 is prevented from becoming lost by its connection to the body 20 by the chain 120. To complete the setting up of the toy in its boat simulating configuration, the boat simulating assembly 100 is mounted by inserting the mast 101 into the vertical socket 51 in the simulated boat deck 50.

To set up the toy 10 in its automobile simulating configuration, the boat simulating assembly 100 is, of course, removed and the motor simulating discs 134 are pivoted inwardly into their retracted positions engaging the central post 132. The rudder member 110 is slid into its central, automobile simulating position in the vertical slot 60 so that the upper bore 113 in the rudder member is aligned with the pair of aligned bores 62 in the ears 61 and is secured in said position by insertion of the pin 115 through the said bores. The wings 170 are pivoted into their retracted, automobile simulating positions within the wing receiving slots 70 in the sides 28 of the body 20 and secured therein by utilizing the swivels 140 and the thumbscrews 150 and 160 in a manner similar to that previously described for placing the wings in their aircraft simulating position.

Once the toy 10 is set up in the desired configuration, the operator takes a position in the cockpit 40 for motivation of the toy over the ground surface 29 with the pedal driven propelling mechanism 90 in a path controlled through the steering mechanism 80.

Although the invention has been herein shown and described in what is conceived to be the most practical and preferred embodiment, it is recognized that departures may be made therefrom within the scope of the invention, which is not to be limited to the illustrative details disclosed.

Having described my invention what I claim as new and desire to secure by Letters Patent is:

1. A toy comprising:

(A) a body mounted for traversing a supporting surface having a forward portion, a rearward portion, a longitudinal axis substantially parallel to the supporting surface, and a pair of oppositely laterally outwardly opening longitudinal slots, the forward portion of the body extending forwardly of the slots and curving convergently inwardly therefrom;

(B) a pair of plate-like members each having a root portion and an opposite tip portion; and (C) swivel means individually mounting the root portions of the plate-like members on opposite sides of the body forwardly of the slots for selective positioning of the platelike members longitudinally substantially parallel to the support surface (1) extending transversely inwardly substantially concealed within the slots and with the tip portions rearwardly of their respective root portions, (2) disposed with the tip portions extending laterally outwardly of the body from their respective root portions, and (3) disposed transversely substantially perpendicularly to the supporting surface with the tip portions forward of the root portions and with said members forwardly convergent so that the tip portions are closely adjacent, the plate-like members being curved substantially to conform to the shape of the forward portion of the body when said plate-like members are in their position transversely substantially perpendicularly to the supporting surface with the tip portions closely adjacent to each other forwardly of the root portions, the slots being curved to conform to and to receive the plate-like members.

2. The toy of claim 1 in which the body has an operator's cockpit disposed between the swivel means for mounting the plate-like members, the root portions of said members extend inwardly to and conform to the shape of the cockpit when in their position concealed within the slot, and the tip portions of said members rearwardly of the cockpit extend inwardly substantially to the longitudinal axis.

3. The toy of claim 1 in which the rearward portion of the body has a slot substantially perpendicular to the supporting surface coincident with the longitudinal axis, a planar rudder simulating member mounted for slidable movement in said slot, means for selectively positioning the rudder member in a (A) central position with the rudder member extending substantially equally upwardly and downwardly from the body;

(B) an upper position with the rudder member extending upwardly from the body a greater distance than downwardly; and (C) a lower position with the rudder member extending downwardly from the body a greater distance than upwardly.

4. The toy of claim 1 in which:

(A) a planar radiator simulating member is mounted on the forward end of the body positioned substantially perpendicularly to and coaxially with the longitudinal axis;

(B) a pair of motor simulating discs are individually mounted rearwardly of the radiator member for pivotal movement about the longitudinal axes at the laterally opposite edges of the radiator simulating member selectively to position the motor simulating discs;

(1) in a concealed position substantially within the body, and (2) positions extending oppositely laterally outwardly from the longitudinal pivotal axes, and (C) the motor simulating discs are adapted to be retained in their concealed positions by the plate-like members when the plate-like members are in their transversely vertically disposed positions forwardly converging positions.

5. The toy of claim 4 in which the body has a portion forwardly of the cockpit alternately simulating a hood and a deck and including a socket on said portion; a mast releasably mounted in the socket; and a sail mounted on the mast.

6. A convertible riding toy adapted selectively to simulate an automobile, a sail boat, and an airplane comprising:

(A) a substantially streamlined body having a longitudinal axis, forward and rearward ends, an operator's cockpit, wing receiving slots extended on opposite sides of the body from positions forwardly adjacent to the cockpit rearwardly thereof, and a vertical slot through the rearward end of the body coincident with said axis;

(B) means mounting the body for earth traversing movement;

(C) a pair of elongated concavo-convex wings;

(D) swivel means mounting the wings on opposite sides of the body for selective positioning between (1) outwardly oppositely extended substantially horizontal positions simulating aircraft wings, (2) forwardly extended positions substantially conforming to the body and forwardly convergently extended therefrom simulating the bow of a boat, and (3) rearwardly extended positions retracted into the slots of the body, (E) a planar member simulating an automotive radiator;

(F) means rigidly mounting said planar member in a substantially vertical plane transversely of the forward end of the body in coaxial relation thereto;

(G) a pair of discs simulating aircraft motors;

(H) means mounting the discs on the body for pivotal movement between retracted positions between the planar member and the body and outwardly pivoted motor simulating positions, said discs being engaged by and held in said retracted position by the wings when the wings are in bow simulating position; and (I) a planar tail piece mounted for slidable movement in the slot in the body for selective positioning between an upper aircraft rudder simulating position extended above the body and a lower boat rudder simulating position extended below the body.

7. A toy comprising:

(A) an elongated body having predetermined forward and rearward end portions and a longitudinal axis;

(B) a pair of elongated concavo-convex wings each having a root portion and an opposite tip portion;

(C) swivel means mounting the root portions of the wings on opposite sides of the body for selective positioning between (1) outwardly oppositely extended positions in a plane substantially common to the axis simulating aircraft wings, (2) forwardly convergently extended positions simulating the bow of a boat with the wings transversely substantially right angularly related to said plane, and (3) positions rearwardly extended along the body to simulate an automobile; and (D) means for selectively constraining the wings to said positions.

8. A toy comprising:

(A) an elongated body having endwardly tapered forward and rearward end portions;

(B) means mounting the body to traverse a support surface;

(C) a pair of elongated plate-like members each having a root portion and an opposite tip portion;

(D) means mounting the root portions of the plate-like members on opposite sides of the body intermediate the opposite end portions thereof for selective positioning between (1) outwardly oppositely extended positions simulating aircraft wings with the members transversely and longitudinally substantially horizontally disposed, (2) forwardly convergently extended positions simulating the bow of a boat with the members longitudinally substantially horizontally and transversely substantially vertically disposed with the root portions fitted to the tapered forward end portion of the body and the tip portions convergent forwardly of the body, and (3) retracted positions rearwardly extended along the body to simulate an automobile; and (E) means for selectively constraining said platelike members to said positions.

9. The toy of claim 8 in which the body is slotted longitudinally rearwardly of the mounting means on opposite sides of the body, and when retracted the members are longitudinally and transversely substantially horizontal, and the members are fitted to and received by the slots.

* * * * *